US009753401B2

(12) United States Patent
Yamane et al.

(10) Patent No.: US 9,753,401 B2
(45) Date of Patent: Sep. 5, 2017

(54) POWDER CONTAINER AND IMAGE FORMING APPARATUS INCORPORATING SAME

(71) Applicants: Masayuki Yamane, Kanagawa (JP); Takeroh Kurenuma, Kanagawa (JP); Masahiro Watanabe, Kanagawa (JP)

(72) Inventors: Masayuki Yamane, Kanagawa (JP); Takeroh Kurenuma, Kanagawa (JP); Masahiro Watanabe, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/182,088

(22) Filed: Jun. 14, 2016

(65) Prior Publication Data

US 2016/0378021 A1 Dec. 29, 2016

(30) Foreign Application Priority Data

Jun. 24, 2015 (JP) ..... 2015-126744

(51) Int. Cl.
*G03G 15/08* (2006.01)

(52) U.S. Cl.
CPC ..... *G03G 15/0865* (2013.01); *G03G 15/0837* (2013.01); *G03G 15/0872* (2013.01)

(58) Field of Classification Search
CPC ..... G03G 15/0865; G03G 15/0872; G03G 15/0837
See application file for complete search history.

(56) References Cited

U.S. PATENT DOCUMENTS 5,890,040 A * 3/1999 Matsuoka ..... G03G 15/0868 222/DIG. 1
5,903,806 A * 5/1999 Matsuoka ..... G03G 15/0886 222/DIG. 1

(Continued)

FOREIGN PATENT DOCUMENTS

EP 0 853 260 A2 7/1998
JP 2012-226289 11/2012

(Continued)

OTHER PUBLICATIONS

U.S. Appl. No. 14/255,629, filed Apr. 17, 2014.
Extended European Search Report issued Oct. 21, 2016 in Patent Application No. EP16175995.6.

*Primary Examiner* — G. M. Hyder
(74) *Attorney, Agent, or Firm* — Oblon, McClelland, Maier & Neustadt, L.L.P.

(57) ABSTRACT

A powder container includes a rotatable powder storage to store powder for image formation, a conveyor to transport the powder inside the powder storage, and a scooping portion to scoop the powder inside the powder storage. The conveyor transports the powder in a powder conveyance direction parallel to a rotation axis of the powder storage toward an opening at one end of the powder storage. The scooping portion causes the powder to flow to the opening. The scooping portion includes a scooping face extending from an inner face of the powder storage toward the rotation axis of the powder storage, and a rim disposed along an inner end of the scooping face in a diameter direction of the powder storage, and at least a portion of the rim protruding downstream beyond the scooping face in a rotation direction of the powder storage.

8 Claims, 12 Drawing Sheets

(56) References Cited

U.S. PATENT DOCUMENTS

| | | | | |
|---|---|---|---|---|
| 6,104,902 | A * | 8/2000 | Meyer | G03G 15/0868 222/DIG. 1 |
| 7,729,644 | B2 * | 6/2010 | Thornton | G03G 15/087 399/262 |
| 7,747,202 | B2 * | 6/2010 | Taguchi | G03G 15/0868 399/120 |
| 7,817,944 | B2 * | 10/2010 | Li | G03G 15/087 399/258 |
| 8,824,934 | B2 * | 9/2014 | Hayashi | G03G 15/0872 399/258 |
| 2006/0099012 | A1 | 5/2006 | Kita et al. | |
| 2007/0081834 | A1 | 4/2007 | Koyama et al. | |
| 2007/0086809 | A1 | 4/2007 | Yamane | |
| 2007/0140747 | A1 | 6/2007 | Kita et al. | |
| 2007/0147900 | A1 | 6/2007 | Taguchi et al. | |
| 2007/0147902 | A1 | 6/2007 | Taguchi et al. | |
| 2010/0150605 | A1 | 6/2010 | Yomoda et al. | |
| 2010/0226690 | A1 | 9/2010 | Kadota et al. | |
| 2011/0002713 | A1 | 1/2011 | Taguchi et al. | |
| 2012/0141169 | A1 | 6/2012 | Yamane et al. | |
| 2012/0200871 | A1 | 8/2012 | Takahashi et al. | |
| 2012/0308242 | A1 | 12/2012 | Yamane et al. | |
| 2013/0045029 | A1 | 2/2013 | Kimura et al. | |
| 2013/0064570 | A1 | 3/2013 | Yamane et al. | |
| 2013/0129391 | A1 | 5/2013 | Kadota et al. | |
| 2014/0314443 | A1 | 10/2014 | Takahashi et al. | |
| 2014/0341602 | A1 | 11/2014 | Takahashi et al. | |

FOREIGN PATENT DOCUMENTS

| | | |
|---|---|---|
| JP | 2012-230343 | 11/2012 |
| JP | 2013-072921 | 4/2013 |
| WO | WO 2013/077474 A1 | 5/2013 |

* cited by examiner

POWDER CONTAINER AND IMAGE FORMING APPARATUS INCORPORATING SAME

CROSS-REFERENCE TO RELATED APPLICATIONS

This patent application is based on and claims priority pursuant to 35 U.S.C. §119(a) to Japanese Patent Application No. 2015-126744, filed on Jun. 24, 2015, in the Japan Patent Office, the entire disclosure of which is hereby incorporated by reference herein.

BACKGROUND

Technical Field

Embodiments of the present invention generally relate to a powder container and an image forming apparatus, such as a copier, a printer, a facsimile machine, or a multifunction peripheral having at least two of copying, printing, facsimile transmission, plotting, and scanning capabilities.

Description of the Related Art

Image forming apparatuses such as copiers use a powder container to store powdered toner (i.e., developer or powder for image formation) and a powder supply device to supply the toner from the powder container to a developing device.

There are powder containers that include a rotatable powder storage to store toner and a conveyor to transport the toner inside the powder storage and configured, as the powder storage rotates, to scoop up the toner inside the powder storage and cause the toner to flow to an opening disposed in a downstream portion of the powder storage in the direction in which the conveyor transports the toner.

SUMMARY

An embodiment of the present invention provides a powder container that includes a rotatable powder storage to store powder for image formation, a conveyor to transport the powder inside the powder storage, and a scooping portion to scoop the powder inside the powder storage. The conveyor transports the powder in a powder conveyance direction parallel to a rotation axis of the powder storage toward an opening at one end of the powder storage. The scooping portion causes the powder to flow to the opening. The scooping portion includes a scooping face extending from an inner face of the powder storage toward the rotation axis of the powder storage, and a rim disposed along an inner end of the scooping face in a diameter direction of the powder storage. On a cross section perpendicular to the rotation axis of the powder storage, at least a portion of the rim projects downstream beyond the scooping face in a rotation direction of the powder storage.

In another embodiment, an image forming apparatus includes the powder container described above, a powder supply device to transport the powder from the powder container; and an image forming unit including an image bearer. The image forming unit is configured to form an image on the image bearer using the powder transported from the powder container by the powder supply device.

BRIEF DESCRIPTION OF THE SEVERAL VIEWS OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION

Figure 1A:
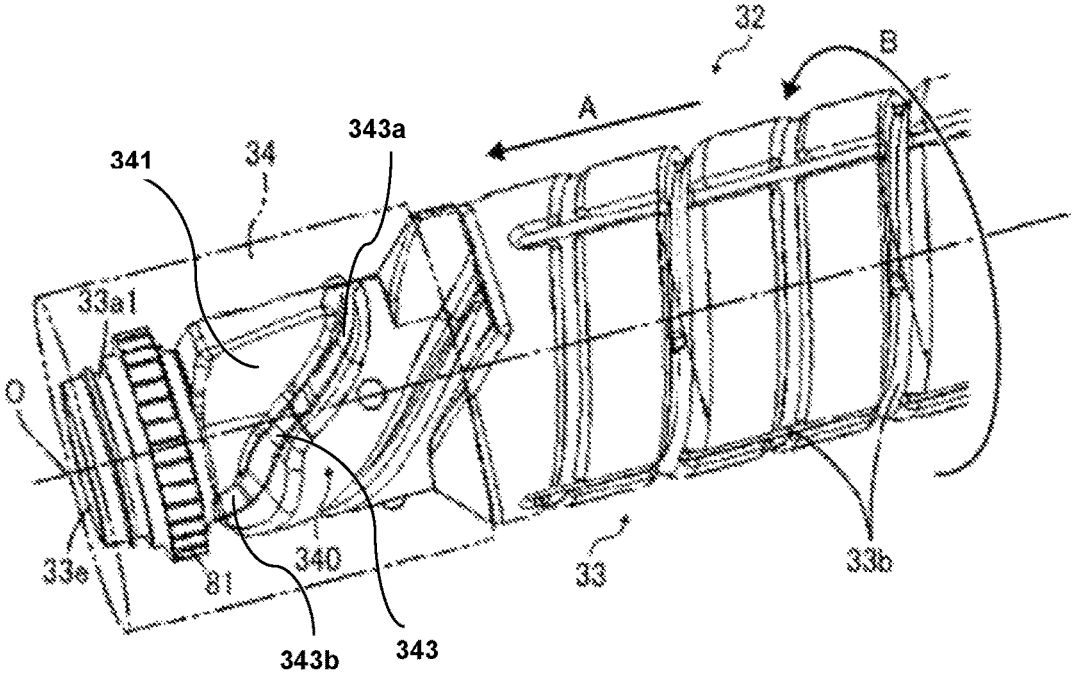
FIG. 1A is an enlarged view of a main part of a powder container according to an embodiment.

In describing preferred embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

It is to be noted that spatially relative terms, such as "beneath", "below", "lower", "above", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors used herein interpreted accordingly.

Referring now to the drawings, wherein like reference numerals designate identical or corresponding parts throughout the several views thereof, and particularly to FIG. 1, a multicolor image forming apparatus according to an embodiment of the present invention is described.

With reference to FIG. 1, descriptions are given below of an image forming apparatus according to an embodiment of the present disclosure. It is to be noted that each element identical or corresponding throughout the embodiments is given an identical or similar reference character, and redundant descriptions are omitted. In the drawings, some elements may be omitted or simplified as required for ease of understanding. It is to be noted that suffixes Y, M, C, and K attached to reference numerals indicate that components indicated thereby are used for forming yellow, magenta, cyan, and black images, respectively, and may be omitted when color discrimination is not necessary.

Figure 2:
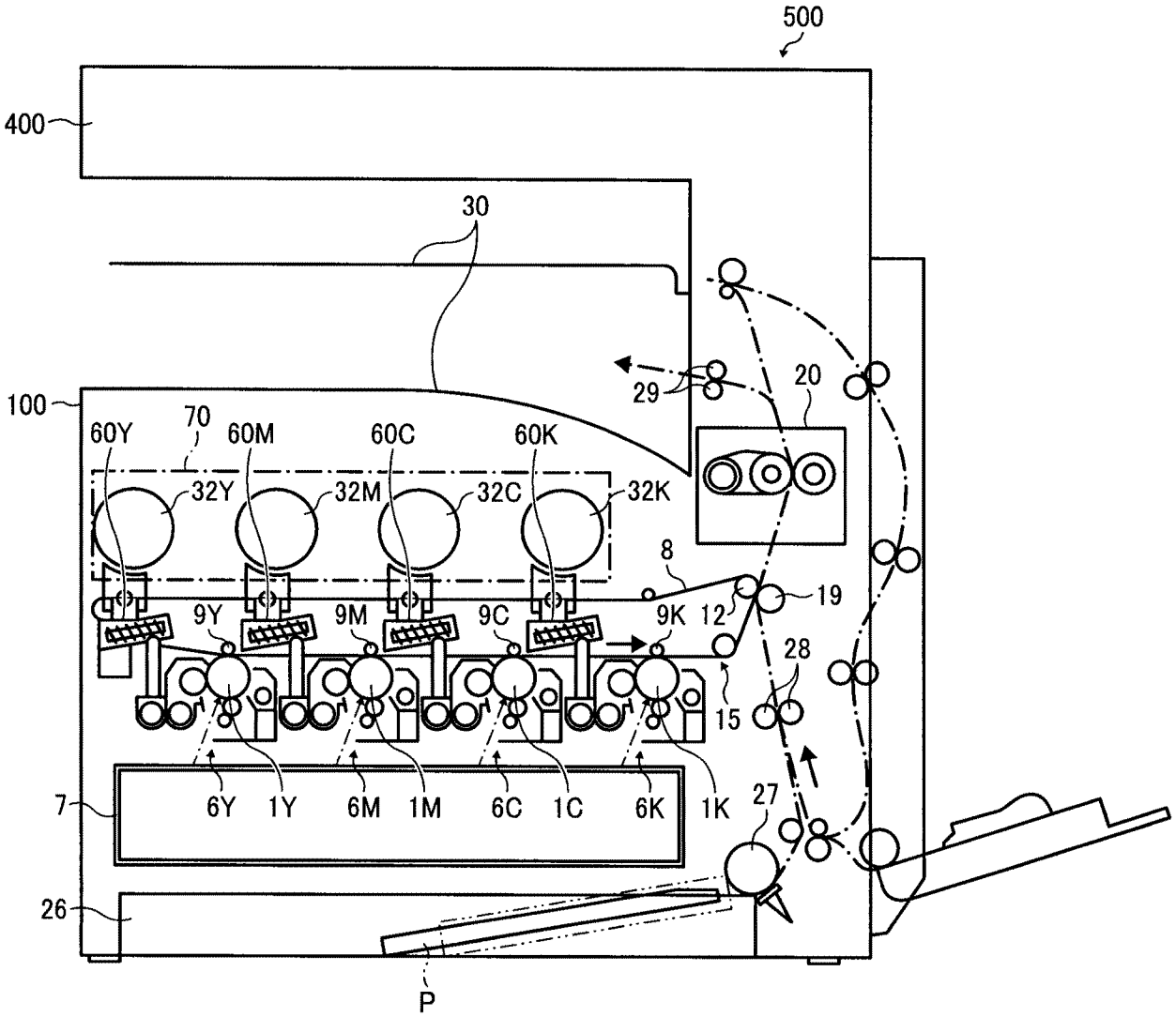
FIG. 2 is a schematic view of an image forming apparatus according to an embodiment.

FIG. 2 is a schematic diagram illustrating an overall configuration of an electrophotographic tandem-type color copier (hereinafter, referred to as "a copier 500") serving as an image forming apparatus according to an embodiment. The copier 500 includes a body (hereinafter "printer body 100"), a sheet feeder 26, and a scanner 400 (i.e., a scanner section) mounted in the printer body 100.

The copier 500 includes a toner container holder 70 disposed in an upper section of the printer body 100. Four toner containers 32Y, 32M, 32C, and 32K (also collectively "toner containers 32") to contain yellow, magenta, cyan, and black toners, respectively, are removably installable in the toner container holder 70. That is, the toner containers 32 are replaceable.

An intermediate transfer unit 15 is disposed below the toner container holder 70. The intermediate transfer unit 15 includes an intermediate transfer belt 8 serving as an intermediate transfer member. The intermediate transfer member is not limited to an intermediate transfer belt but can be an intermediate transfer drum. The printer body 100 includes four image forming units 6Y, 6M, 6C, and 6K (collectively "image forming units 6") disposed side by side, facing the intermediate transfer belt 8 from below the intermediate transfer belt 8.

Toner supply devices 60Y, 60M, 60C, and 60K (collectively "toner supply devices 60") are disposed below the respective toner containers 32Y, 32M, 32C, and 32K (replaceable components) containing yellow, magenta, cyan, and black toners. Each toner supply device 60 (i.e., a powder supply device or a toner conveying device) supplies the toner contained in the corresponding toner container 32 to a developing device 5 of the corresponding image forming unit 6.

Descriptions are given below of the image forming units 6 and the toner supply devices 60. The image forming units 6 are similar in structure and the toner supply devices 60 are similar in structure although the color of toner is different. Thus, the suffixes Y, M, C, and K are omitted below.

Figure 3:
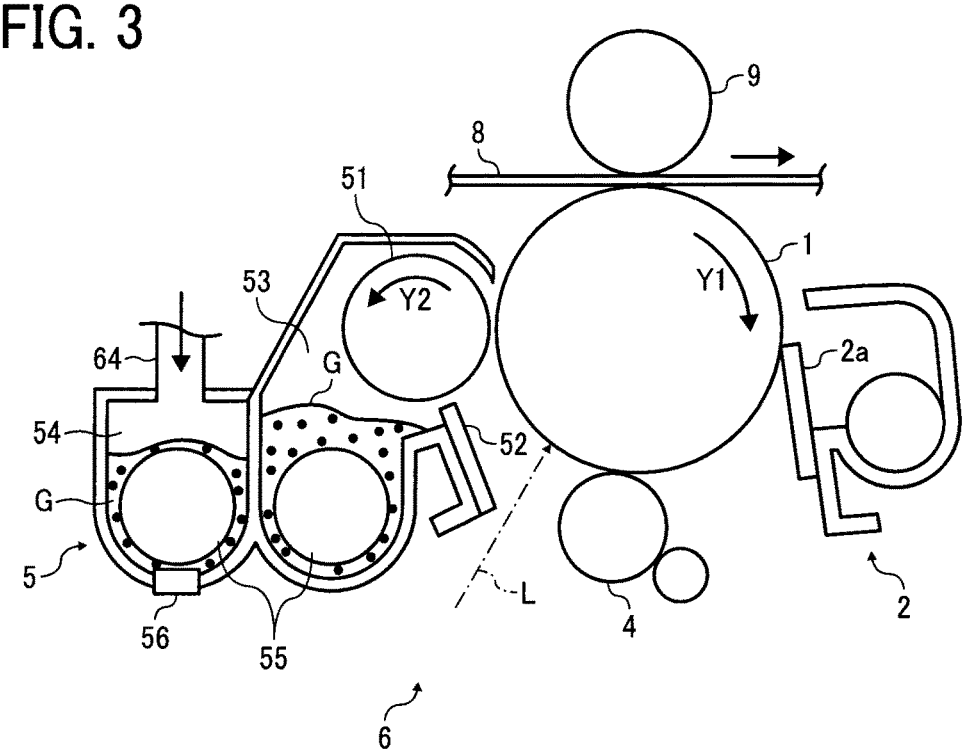
FIG. 3 is a schematic diagram illustrating an image forming unit of the image forming apparatus illustrated in FIG. 2.

Referring to FIG. 3, each image forming unit 6 includes a photoconductor drum 1 (IY, 1M, 1C, and 1K in FIG. 2) and further includes a charging device 4, the developing device 5, a cleaning device 2, a discharger, and the like disposed around the photoconductor drum 1 serving as an image bearer. In the image forming unit 6, toner images are formed on the photoconductor drum 1 through an image forming process, namely, charging, exposure, developing, transfer, and cleaning processes.

As the photoconductor drum 1 is rotated clockwise (indicated by arrow Y1) in FIG. 3 by a driving motor, at a position facing the charging device 4, the charging device 4 charges the surface of the photoconductor drum 1 uniformly.

When the photoconductor drum 1 reaches a position to receive a laser beam L emitted from an exposure unit 7 (illustrated in FIG. 2), an electrostatic latent image is formed thereon by exposure scanning (exposure process) at that position.

Then, the photoconductor drum 1 reaches a position facing the developing device 5, where the latent image is developed with toner into a toner image (i.e., a developing process). Subsequent to the developing process, surface of the photoconductor drum 1 reaches a position facing a primary-transfer bias roller 9 (9Y, 9M, 9C, and 9K in FIG. 2) via the intermediate transfer belt 8, and the toner image is transferred therefrom onto the intermediate transfer belt 8 (i.e., a primary transfer process). After the primary transfer process, a certain amount of toner tends to remain untransferred on the photoconductor drum 1.

When the surface of the photoconductor drum 1 reaches a position facing the cleaning device 2, a cleaning blade 2*a* of the cleaning device 2 mechanically collects the untransferred toner from the photoconductor drum 1 (i.e., a cleaning process).

Further, when the surface of the photoconductor drum 1 reaches a position facing the discharger, residual potentials on the surface thereof are removed.

Thus, a sequence of image forming processes performed on each photoconductor drum 1 completes.

As illustrated in FIG. 2, the intermediate transfer unit 15 includes the intermediate transfer belt 8, the four primary-transfer bias rollers 9Y, 9M, 9C, and 9K, a secondary-transfer backup roller 12, multiple rollers, and a belt cleaner. The intermediate transfer belt 8 is supported by the multiple rollers and is rotated in the direction indicated by an arrow illustrated in FIG. 2 as the secondary-transfer backup roller 12 rotates.

The four primary-transfer bias rollers 9 are pressed against the corresponding photoconductor drums 1 via the intermediate transfer belt 8, and four contact portions between the primary-transfer bias rollers 9 and the corresponding photoconductor drums 1 are hereinafter referred to as primary transfer nips. Each primary-transfer bias roller 9 receives a transfer bias in the polarity opposite the polarity of toner. While rotating in the direction indicated by the arrow illustrated in FIG. 2, the intermediate transfer belt 8 sequentially passes through the primary transfer nips between the photoconductor drums 1 and the corresponding primary-transfer bias rollers 9. Then, the single-color toner images are transferred from the photoconductor drums 1 primarily and superimposed one on another into a four-color toner image on the intermediate transfer belt 8.

Then, the intermediate transfer belt 8 carrying the four-color toner image reaches a position facing a secondary transfer roller 19. The secondary-transfer backup roller 12 and the secondary transfer roller 19 press against each other via the intermediate transfer belt 8, and the contact portion therebetween is referred to as a secondary-transfer nip. The four-color toner image is transferred from the intermediate transfer belt 8 onto a recording sheet P (recording medium) transported to the secondary-transfer nip (i.e., a secondary transfer process). A certain amount of toner tends to remain untransferred on the intermediate transfer belt 8 after the secondary transfer process.

When the intermediate transfer belt 8 reaches a position facing the belt cleaner, the untransferred toner is collected from the intermediate transfer belt 8 by the belt cleaner. Thus, a sequence of image forming processes performed on the intermediate transfer belt 8 completes.

The sheet feeder 26 disposed in the lower portion of the printer body 100 feeds the recording sheet P to the secondary transfer nip via a sheet feeding roller 27, a registration roller pair 28, and the like. The sheet feeder 26 contains multiple recording sheets P piled one on another. The sheet feeding roller 27 rotates counterclockwise in FIG. 2 to feed the recording sheet P on the top in the sheet feeder 26 (i.e., a sheet tray) toward a nip of the registration roller pair 28. The registration roller pair 28 rotates to transport the recording sheet P to the secondary transfer nip, timed to coincide with the arrival of the four-color or multicolor toner image on the intermediate transfer belt 8. Thus, the multicolor toner image is recorded on the recording sheet P.

Subsequently, the recording sheet P carrying the multicolor image is transported to a fixing device 20, where a fixing belt and a pressing roller apply heat and pressure to the recording sheet P to fix the multicolor toner image on the recording sheet P. Alternatively, a fixing device including a fixing roller and a pressure roller pressing each other can be used.

Subsequently, the recording sheet P is discharged by a pair of discharge rollers 29 outside the copier 500. The recording media P are sequentially stacked as output images on a stack section 30. Thus, a sequence of image forming processes performed in the copier 500 is completed.

Next, a configuration and operation of the developing devices 5 is described in further detail below with reference to FIG. 3.

Each developing device 5 includes a developing roller 51 disposed facing the photoconductor drum 1, a doctor blade 52 disposed facing the developing roller 51, two conveying screws 55 respectively disposed in developer containing compartments 53 and 54, and a concentration detector 56 to detect the ratio of toner in developer G. A casing of the developing device 5 is divided, at least partially, into the developer containing compartments 53 and 54. The developing roller 51 includes a stationary magnet or magnet roller, a sleeve that rotates around the magnet, and the like. The developer containing compartments 53 and 54 contain two-component developer G including carrier (carrier particles) and toner (toner particles). The casing of the developing device 5 includes an opening above the developer containing compartment 54, and the developer containing compartment 54 is coupled via the opening to a toner dropping passage 64.

The developing device 5 operates as follows. The sleeve of the developing roller 51 rotates in the direction indicated by arrow Y2 illustrated in FIG. 3. As the sleeve rotates, the developer G is borne on the developing roller 51 by the magnetic field of the magnet and moves along the circumference of the developing roller 51 (in the shape of arc).

The percentage of toner (concentration of toner or ratio of toner to carrier) in the developer G contained in the developing device 5 is adjusted within a predetermined range. More specifically, the toner supply device 60 supplies toner from the toner container 32 to the developer containing compartment 54 according to the consumption of toner in the developing device 5.

While being mixed and stirred with the developer G in the developing device 5, the supplied toner is circulated between the two developer containing compartments 53 and 54 (transported in the direction perpendicular to the surface of the paper on which FIG. 3 is drawn). The toner in developer G is charged by friction with the carrier and electrostatically attracted to the carrier. Then, the toner is carried on the developing roller 51 together with the carrier by a magnetic force generated on the developing roller 51.

The developer G carried on the developing roller 51 is transported in the direction indicated by arrow Y2 in FIG. 3 to the doctor blade 52. The doctor blade 52 adjusts the amount of developer G on the developing roller 51 to a suitable amount, after which the developer G is carried to a developing range facing the photoconductor drum 1. Then, the toner is attracted to the latent image on the photoconductor drum 1 by the magnetic field generated in the developing range. As the sleeve rotates, the developer G remaining on the developing roller 51 reaches an upper part of the developer containing compartment 53 and then drops from the developing roller 51.

Figure 4:
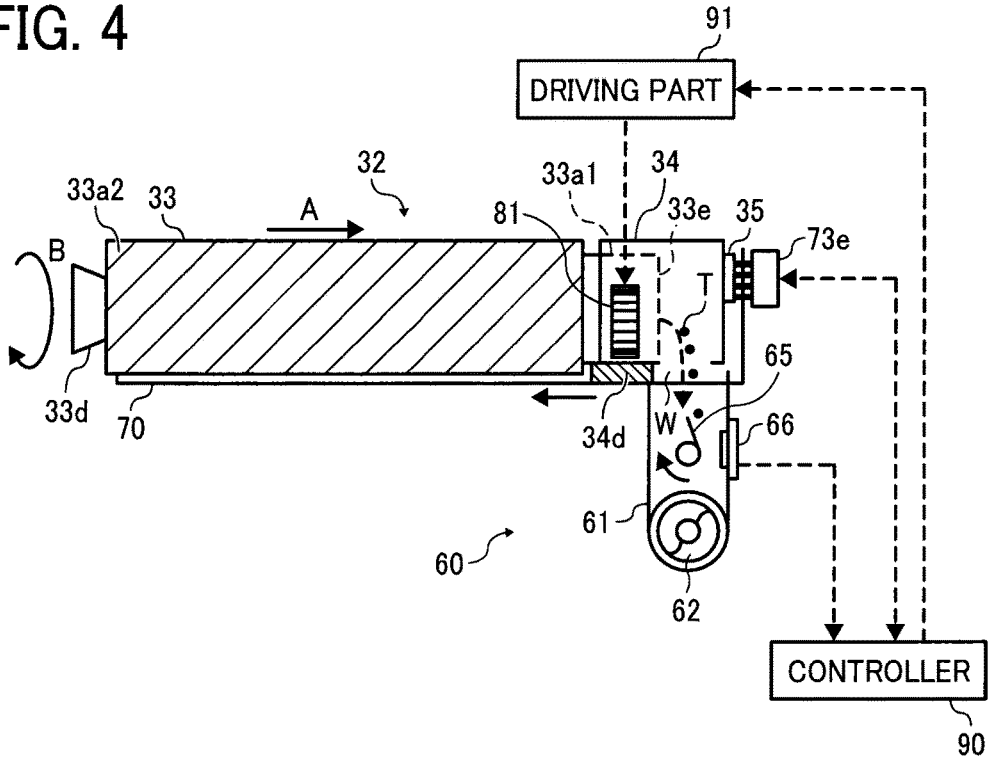
FIG. 4 is a schematic diagram illustrating the powder container being mounted in a powder supply device of the image forming apparatus illustrated in FIG. 2.

Referring to FIG. 4, the toner supply device 60 includes the toner container holder 70, a toner tank 61, a toner conveying screw 62, an agitator 65, a toner end detector 66, and a driving part 91. The toner end detector 66 communicates with a controller 90 of the copier 500, which controls the driving part 91. The controller can be a computer including a central processing unit (CPU) and associated memory units (e.g., ROM, RAM, etc.). The computer performs various types of control processing by executing programs stored in the memory. Field programmable gate arrays (FPGA) may be used instead of CPUs The toner container holder 70 includes, as main components, an insertion hole part 71, a container receiving section 72, and a container-cover receiving section 73. The insertion hole part 71 defines an insertion opening 71*a* for attachment of each of the toner containers 32Y, 32M, 32C, and 32K. The insertion hole part 71 is exposed when a front cover of the copier 500 (on the front side of the paper on which FIG. 2 is drawn) is open. To mount each of the toner containers 32Y, 32M, 32C, and 32K in the toner container holder 70, a longitudinal direction of the toner container 32 is kept horizontal, and the toner container 32 is inserted into insertion opening 71*a* from the front side of the copier 500 to the back side on which the container-cover receiving section 73 is disposed. In FIG. 4, arrow Q indicates the direction in which the toner container 32 is inserted into the toner container holder 70 (hereinafter "attachment direction Q"), arrow Q1 indicates the direction in which the toner container 32 is removed therefrom (hereinafter "detachment direction Q1"), and reference character T represents toner.

Figure 6:
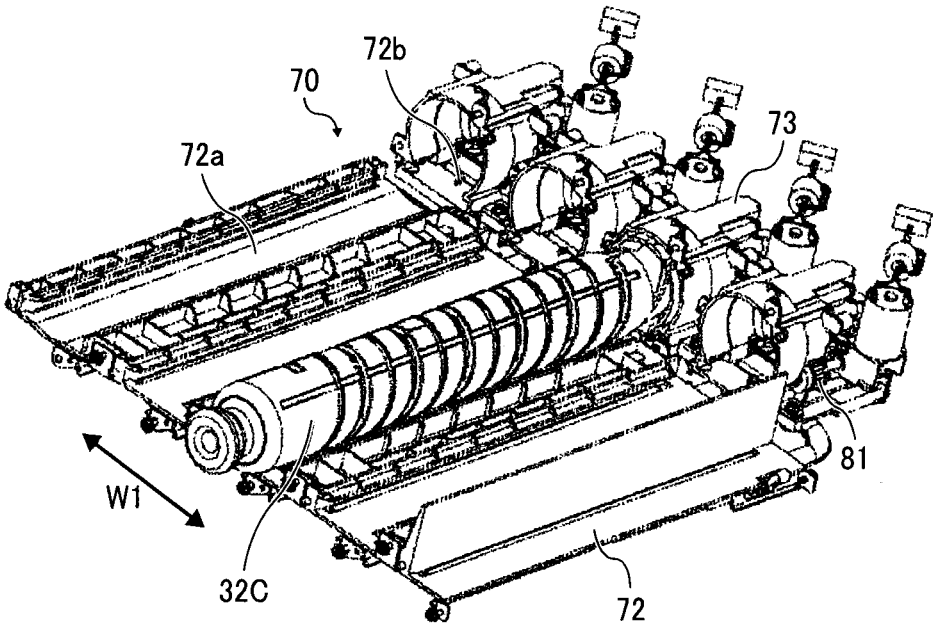
FIG. 6 is a schematic perspective view of the powder supply device in which one powder container is mounted.

When the toner container 32 is coupled to the toner supply device 60, the toner container 32 slides on the container receiving section 72 in the attachment direction Q. As illustrated in FIG. 6, the container receiving section 72 has four upper faces 72*a* divided in a width direction W1 perpendicular to the longitudinal direction (the attachment direction Q) of the toner containers 32. Each upper face 72*a* serves as a container mounting section for one of the toner containers 32Y, 32M, 32C, and 32K. In FIG. 6, the toner container 32C is mounted on the upper face 72*a*.

The container-cover receiving section 73 is disposed on the leading side in the attachment direction Q (on the back side of the copier 500), which opposite the insertion hole part 71 across the container receiving section 72. The container-cover receiving section 73 rotatably supports each toner container 32. The insertion hole part 71 is on the leading side in the detachment direction Q1.

As illustrated in FIG. 4, the toner tank 61 is positioned below a toner outlet W of the toner container 32 mounted in the toner container holder 70 and stores the toner discharged from the toner outlet W. A bottom portion of the toner tank 61 is coupled to an upstream side of the toner conveying screw 62 in the direction in which the toner is transported.

Figure 5:
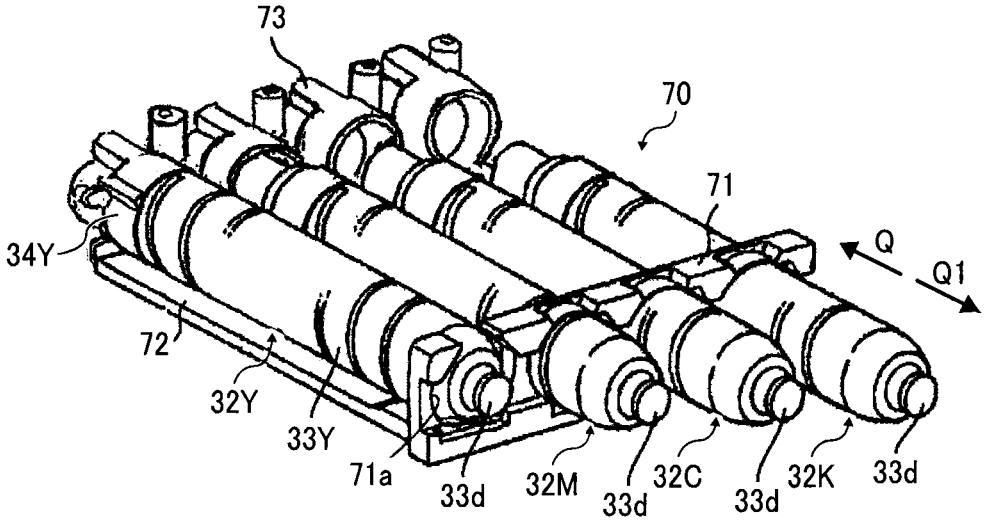
FIG. 5 is a schematic perspective view of the powder supply device in which multiple powder containers are mounted.

The toner end detector 66 is disposed on a side wall of the toner tank 61 at a predetermined height and detects that the amount of toner stored in the toner tank 61 has fallen to or below a predetermined amount. When the controller 90 recognizes that the amount of toner stored in the toner tank 61 is less than the predetermined amount using the toner end detector 66, the controller 90 causes the driving part 91 (including a driving gear 81) to rotate a container body 33 (33Y in FIG. 5) of the toner container 32 for a predetermined period, thereby supplying toner to the toner tank 61. If the toner end detector 66 continues to report "toner end" even when this operation is repeated for a predetermined time period, the controller 90 deems the toner container 32 empty (the end of toner). Then, the controller 90 causes a display of the printer body 100 to instruct users to replace the toner container 32.

The agitator 65 is disposed in a center portion inside the toner tank 61 and inhibits the toner T from aggregating inside the toner tank 61. The agitator 65 rotates clockwise in FIG. 4, thus stirring the toner T in the toner tank 61.

The toner conveying screw 62 transports the toner T stored in the toner tank 61 obliquely upward. Specifically, the toner conveying screw 62 linearly conveys the toner from the bottom (a lowest point) of the toner tank 61 to the upper side of the developing device 5. Then, the toner conveyed by the toner conveying screw 62 drops under the weight thereof through the toner dropping passage 64 and is supplied to the developer containing compartment 54 of the developing device 5.

Next, a structure of the toner container 32 is described below. The toner containers 32Y, 32M, 32C, and 32K have a similar configuration except the color of the toner contained therein, and thus subscripts Y, M, C, and K are omitted below.

Figure 7:
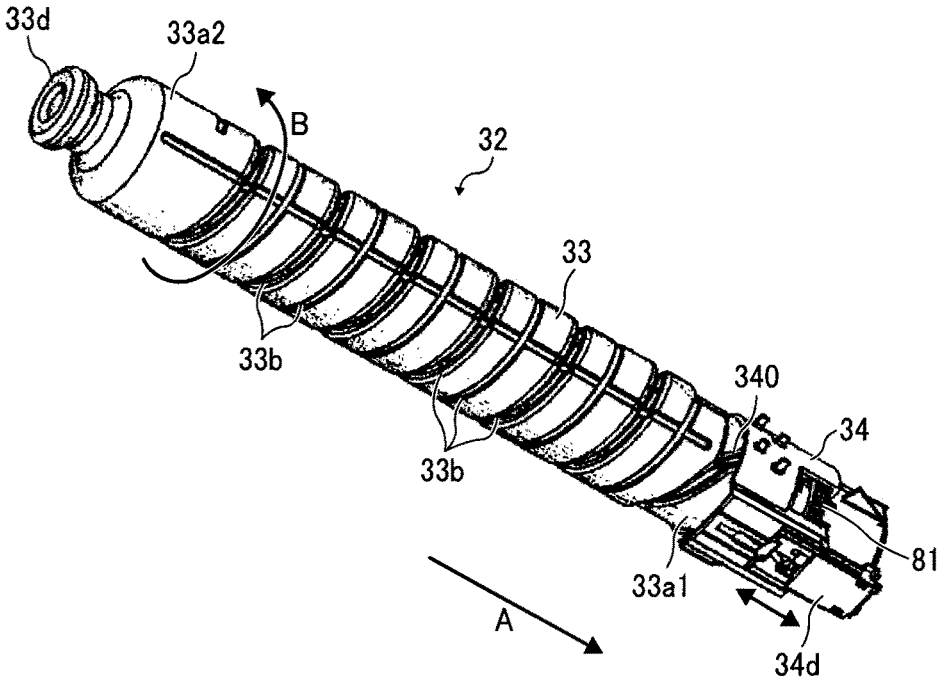
FIG. 7 is an external view of the powder container.

Each toner container 32 is configured to move the toner stored therein to the toner outlet W. As illustrated in FIG. 7, the toner container 32 includes a cap 34 and the container body 33 that is rotatable and serves as a powder storage to store the toner. The cap 34 (34Y in FIG. 5) is supported by the container-cover receiving section 73 of the toner container holder 70 not to rotate.

Figure 8:
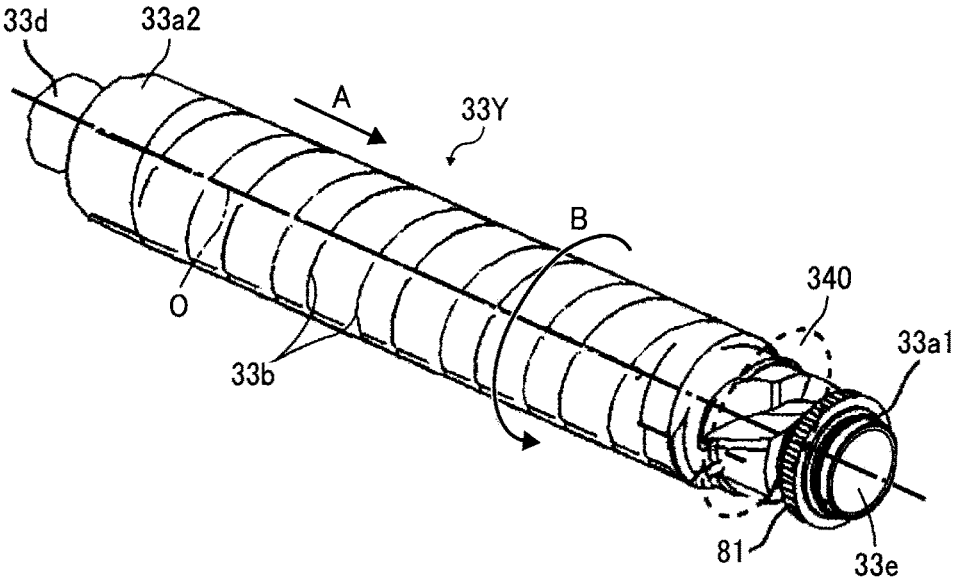
FIG. 8 is a perspective view illustrating a powder storage of the powder container.

As illustrated in FIG. 8, the container body 33 is cylindrical or almost cylindrical and includes an opening 33*e* is disposed at a first end 33*a*1 thereof (i.e., one end in the rotation axis direction of the powder storage) and a handle 33*d* disposed on a second end 33*a*2 opposite the first end 33*a*1. From an inner face 33*c* of the container body 33, a spiral rib 33*b* (i.e., a spiral projection) protrudes inward to transport the toner to the opening 33*e*.

In other words, a spiral groove is formed in an outer face of the container body 33 when viewed from outside. As the container body 33 rotates around a rotation axis O extending in the longitudinal direction thereof, the spiral rib 33*b* disposed inside the container body 33 transports the toner in the container body 33 to the opening 33*e*.

The spiral rib 33*b* serves as a conveyor to transport the powder inside the powder storage to the opening in a powder conveyance direction parallel to a rotation axis of the powder storage. The conveyor to transport the powder inside the powder storage is not limited the spiral rib but can be a screw, an auger, a coil, or a paddle.

The opening 33*e* is disposed at the first end 33*a*1 of the container body 33, which is on the downstream side in the direction indicated by arrow A (in FIGS. 4 and 7), in which the spiral rib 33*b* transports the toner (hereinafter "toner conveyance direction A"). As illustrated in FIG. 4, the opening 33*e* can communicate with the toner outlet W disposed in the cap 34. The first end 33*a*1 (having the opening 33*e*) of the container body 33 is inserted into the cylindrical cap 34, which rotatably supports the container body 33. As illustrated in FIG. 8, a scooping portion 340 is disposed inside the container body 33 and between the opening 33*e* and the spiral rib 33*b* in the longitudinal direction of the container body 33. The scooping portions 340 is designed to scoop up the toner conveyed by the spiral rib 33*b* and cause the toner to flow to the opening 33*e* as the container body 33 rotates. The scooping portion 340 is raised, like a bump, bulge, or projection, from the inner face 33*c* toward the rotation axis O of the container body 33.

The container body 33 is held by the toner container holder 70 rotatably relative to the cap 34 as illustrated in FIG. 4. The driving part 91, which includes the driving gear 81 driven by the driving motor, rotates the container body 33 in the direction indicated by arrow B illustrated in FIG. 4 (hereinafter "rotation direction B"). As the container body 33 rotates, the toner contained in the container body 33 is transported in the longitudinal direction of the container body 33 (the toner container 32) by the spiral rib 33*b* of the container body 33.

Then, the toner is scooped up by the scooping portion 340 and flows to the opening 33*e*, from which the toner flows out the toner container 32 via the toner outlet W of the cap 34. Thus, the toner is supplied to the toner tank 61. Each toner container 32 is replaced with a new one when the operational life thereof expires. As described above, the cover of the printer body 100 is opened in replacement of the toner container 32. It is to be noted that the toner container 32 is replaced when the toner contained therein is consumed and the toner container 32 becomes empty or almost empty.

As illustrated in FIG. 4, the cap 34 includes the toner outlet W, which communicates with the opening 33*e* of the container body 33, and a shutter 34*d* to open and close the toner outlet W. The toner outlet W is disposed on a long-side face, not an end face, of the cap 34. The shutter 34*d* is slidably held by the cap 34. When the toner container 32 is not mounted in the toner container holder 70, the toner outlet W is closed with the shutter 34*d*. As the toner container 32 is mounted in the toner container holder 70, a biasing member 72*b* illustrated in FIG. 6 pushes the shutter 34*d* in the direction to open the toner outlet W.

As illustrated in FIG. 4, an identification (ID) chip 35 serving as a memory device is disposed on the cap 34. The ID chip 35 stores data such as toner information and machine type in which the toner container 32 is mountable, and the stored data is retrievable. Meanwhile, a connector 73*e* is disposed on the toner container holder 70 to face and contact the ID chip 35 when the toner container 32 is mounted in the toner container holder 70. The connector 73*e* provides an electrical connection with the ID chip 35. Contacting the ID chip 35, the connector 73*e* retrieves the data from the ID chip 35 and transmits the data to the controller 90.

Figure 9A:
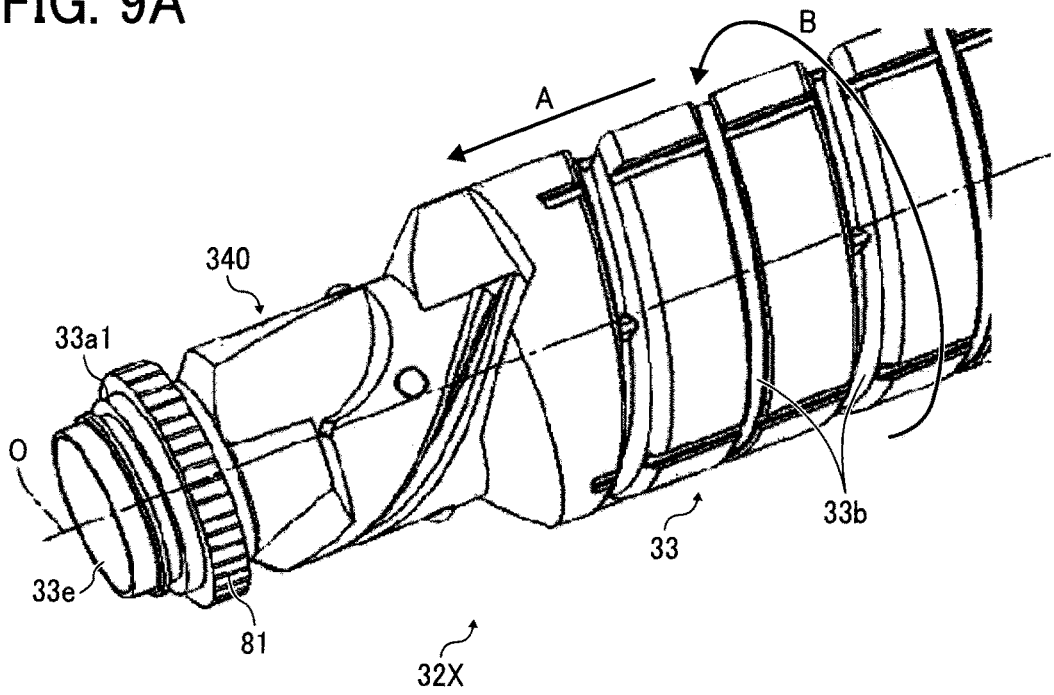
FIGS. 9A and 9B are perspective partial views of a comparative powder container.
Figure 9B:
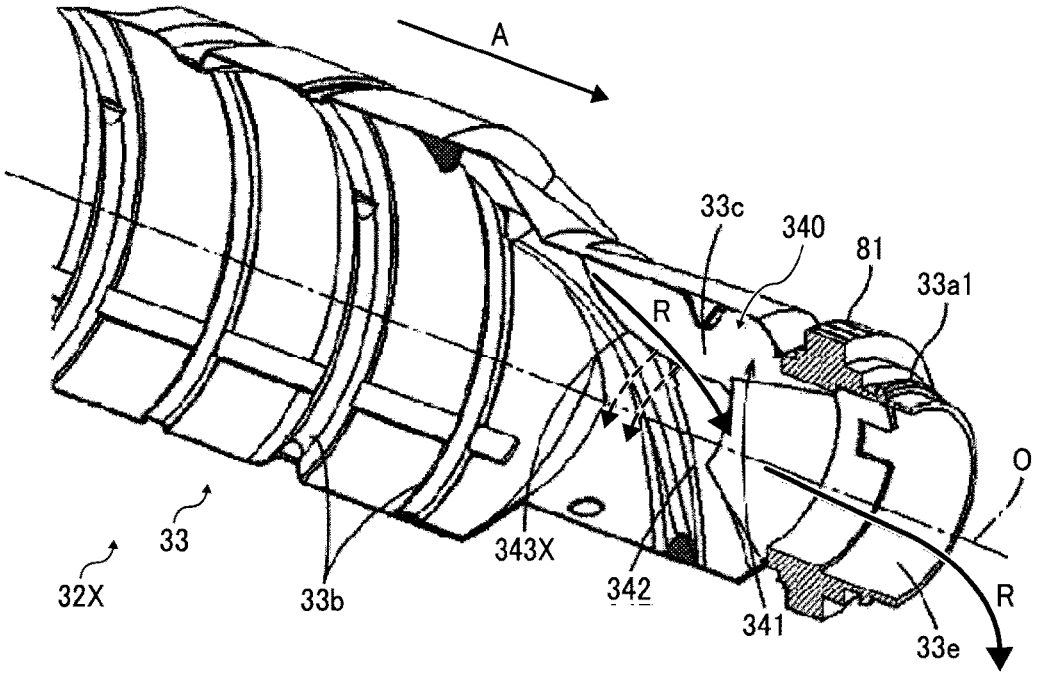
Figure 10:
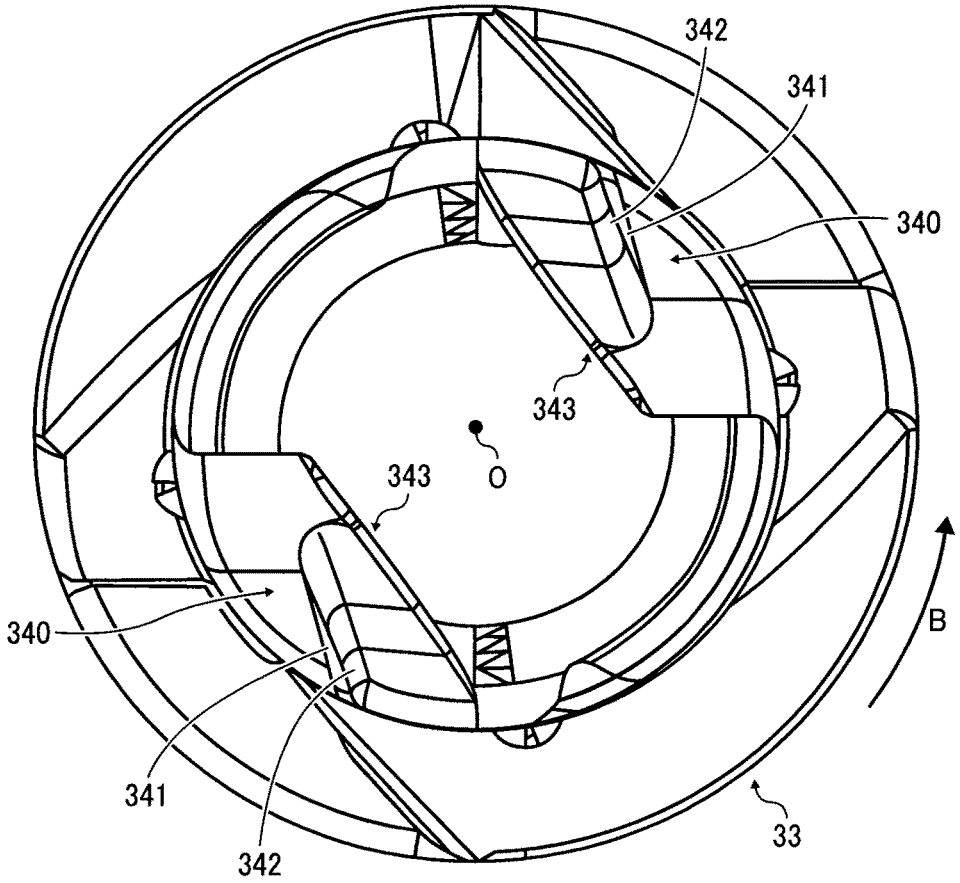
FIG. 10 is an enlarged cross-sectional view of a scooping portion of the powder storage of the powder container illustrated in FIGS. 1A and 1B, on a plane perpendicular to a rotation axis of the storage portion.

In the configuration to scoop up the toner by rotation of the container body 33, the amount of toner discharged from the container body 33 through the opening 33*e* and the toner outlet W tends to decrease when the amount of toner remaining in the container body 33 is small, which is described in further detail below with reference to FIGS. 9A and 9B. FIGS. 9A and 9B illustrate a comparative toner container 32X, in which the scooping portion 340 of the container body 33 includes a scooping face 341. A rim 343X of the scooping face 341 does not protrude from the scooping face 341 in the axial direction of the comparative toner container 32X. The scooping face 341 extends from the inner face 33*c* of the container body 33 toward the rotation axis O of the container body 33, and rim 343X is disposed along an inner end 342 of the scooping face 341 on the side of the rotation axis O. The inner end 342 is on the inner side in the diameter direction of the container body 33. As the container body 33 rotates, the scooping face 341 scoops up the toner transported by the spiral rib 33*b* as well as the toner accumulating on a lower part of the container body 33. The scooped toner flows to the opening 33*e* in a lump as indicated by arrow R in FIG. 9B. Through the observation of the flow of the scooped toner, the inventors have found that the scooped toner spills over the scooping face 341 as indicated by broken arrows illustrated in FIG. 9B.

When the amount of toner inside the container body 33 is sufficient, the amount of toner scooped is greater, and the toner remains on the scooping face 341 has a certain weight even if the toner spills out the rim 343X of the scooping face 341. Accordingly, an inertial force at the opening 33*e* is sufficient for the toner to flow. As the amount of toner in the container body 33 decreases, however, the amount of toner scooped is reduced. Since some of the scooped toner spills out the rim 343X, the weight of toner decreases. Accordingly, it is conceivable that the amount of discharged toner decreases since the inertial force to cause the toner to flow into the opening 33*e* becomes weaker.

Figure 1B:
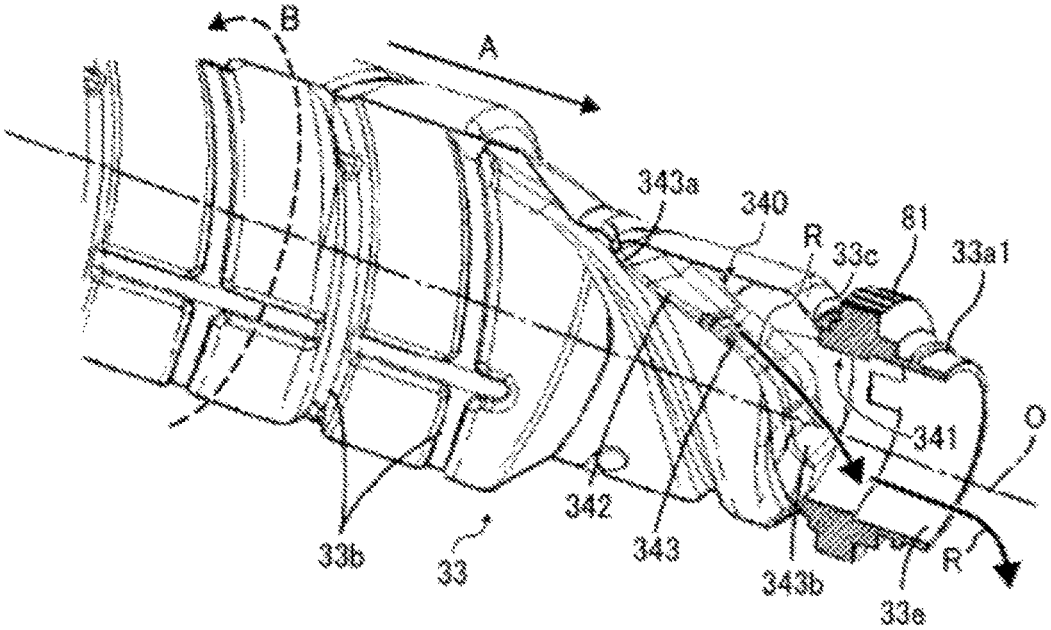
FIG. 1B is an enlarged cross-sectional view of the main part of the powder container illustrated in FIG. 1A.
Figure 13:
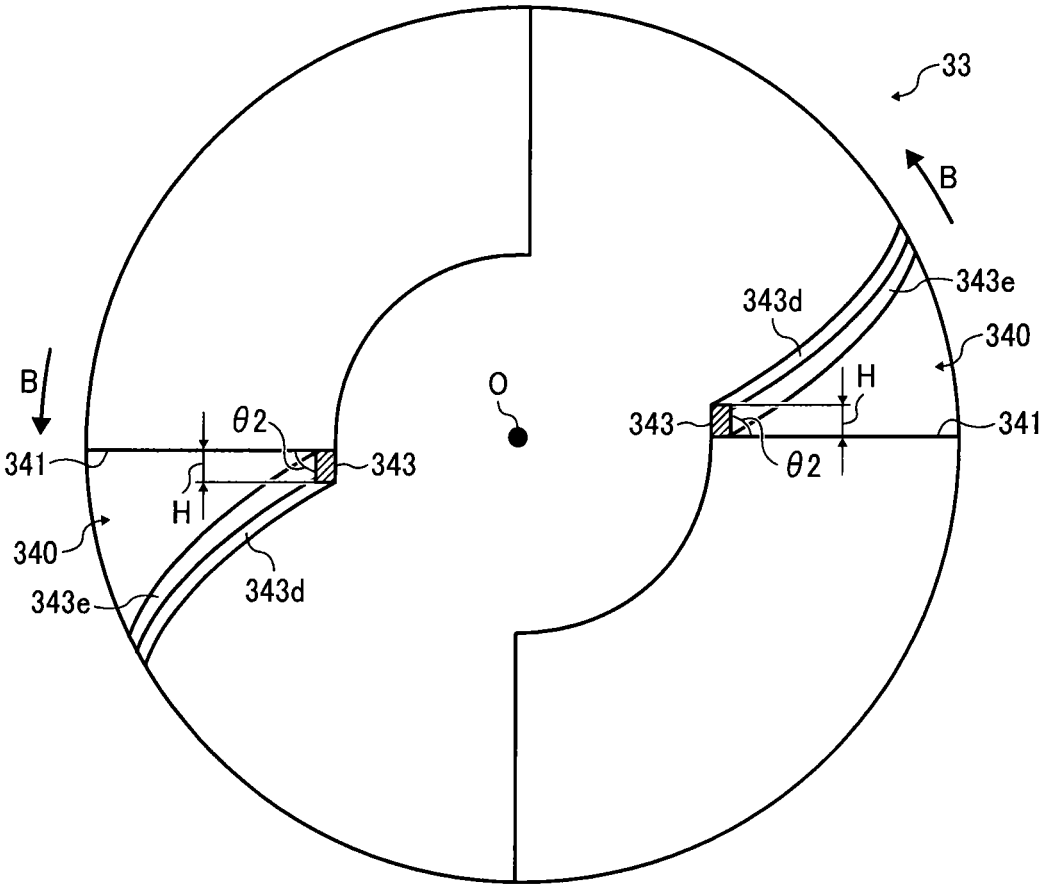
FIG. 13 is an enlarged schematic diagram illustrating a projecting amount of the protruding rim from a scooping face and an angle between an inner face of the protruding rim and the scooping face.

In view of the foregoing, in the toner container 32 according to the present embodiment, as illustrated in FIGS. 1A and 1B, the scooping portion 340 to cause the toner to flow to the opening 33*e* includes the scooping face 341, which extends from the inner face 33*c* of the container body 33 toward the rotation axis O of the container body 33, and a protruding rim 343 along the inner end 342 of the scooping face 341 (on the side of the rotation axis O or inner side in the diameter direction of the container body 33). In particular, at least a portion of the protruding rim 343 projects downstream beyond the scooping face 341 in the rotation direction B of the container body 33 on a cross section perpendicular to the rotation axis O of the container body 33, as illustrated in FIG. 13. In FIG. 13, although the protruding rim 343 is not necessarily in an arc shape conforming to the circumference of the container body 33, the protruding rim 343 projects downstream beyond the scooping face 341 in the rotation direction B.

In the present embodiment, the scooping face 341 is flat. The protruding rim 343 can protrude from the scooping face 341 in the axial direction of the container body 33 as well.

The protruding rim 343 extends continuously from an upstream end 343*a* to a downstream end 343*b* in the toner conveyance direction A. The protruding rim 343 forms a guide wall on the inner end 342 of the scooping face 341. In other words, the protruding rim 343 includes a projecting portion extending from the upstream end 343*a*, at which swelling starts, to the downstream end 343*b* disposed at 180 degrees from the upstream end 343*a* and opposite the upstream end 343*a* in the direction of arch-shaped circumference of the container body 33. The downstream end 343*b* of the protruding rim 343 is located between the opening 33*e* and the upstream end 343*a* of the protruding rim 343 in the toner conveyance direction A. That is, the downstream end 343*b* is on the side of the opening 33*e*.

Thus, in the present embodiment, the scooping portion 340 to cause the toner to flow to the opening 33*e* includes the scooping face 341, which extends from the inner face 33*c* of the container body 33 toward the rotation axis O of the container body 33, and at least a portion of the protruding rim 343 on the scooping face 341 projects beyond the scooping face 341 to the downstream side in the rotation direction B in which the container body 33 rotates. Accordingly, even when the scooped toner moves on the scooping face 341 to the rotation axis O as the container body 33 rotates, the toner is dammed up by the protruding rim 343 projecting beyond the scooping face 341 in the rotation direction B. With this configuration, even when the amount of scooped toner decreases as the amount of toner in the container body 33 decreases, the scooped toner is inhibited from spilling out the protruding rim 343. Accordingly, decreases in the weight of toner are suppressed, thereby suppressing decreases in the inertial force to cause the toner to flow in the opening 33*e*. This configuration can keep the amount of discharged toner stable and simultaneously reduce the amount of toner that is not discharged but is inevitably left inside the toner container 32.

Since the scooping face 341 is flat in the present embodiment, the scooped toner is not blocked by the scooping face 341 but can move to the protruding rim 343. Then, the toner scooped up by the scooping face 341 is efficiently supplied from the protruding rim 343 to the opening 33*e*, thereby keeping the amount of discharged toner stable.

Figure 11:
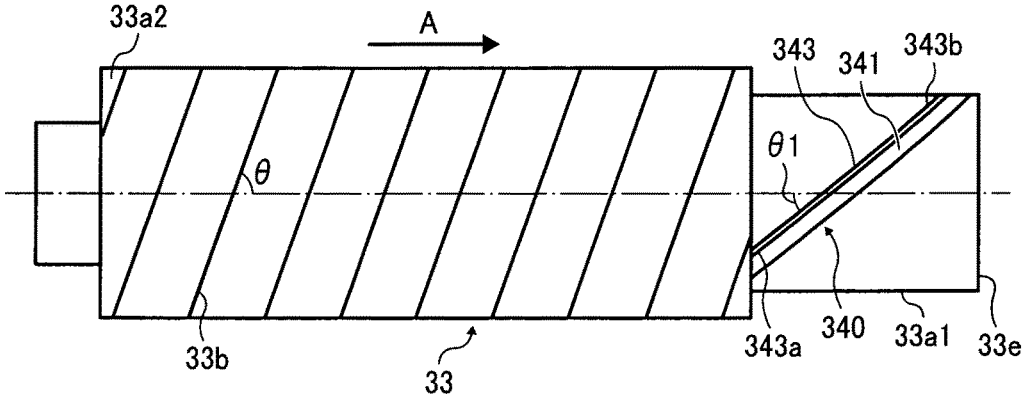
FIG. 11 is a schematic diagram illustrating an inclination of a spiral rib relative to a toner conveyance direction and an inclination of a protruding rim of the scooping portion in the toner container illustrated in FIGS. 1A and 1B.

As illustrated in FIG. 11, the protruding rim 343 is spiral-shaped such that an inclination θ1 of the protruding rim 343 relative to the toner conveyance direction A is smaller than an inclination θ of the spiral rib 33*b* relative to the toner conveyance direction A. The inclination θ is the smaller of two angles between a line parallel to the toner conveyance direction A and the spiral rib 33*b*. The inclination θ1 is the smaller of two angles between the line parallel to the toner conveyance direction A and the protruding rim 343.

Making the inclination θ1 of the protruding rim 343 of the scooping portion 340 smaller than the inclination θ of the spiral rib 33*b* is advantageous in scooping the powdered toner and accordingly reducing the amount of toner left in the container body 33. Thus, a sufficient amount of toner can be scooped, thereby better suppressing the decrease in the amount of toner discharged from the toner container 32.

In the present embodiment, there are two scooping faces 341 disposed at 180 phase from each other in the rotation direction B of the container body 33 around the rotation axis O. Accordingly, each time the container body 33 makes a half-turn, the toner is scooped and caused to flow to the opening 33*e*. Therefore, even when the amount of toner remaining in the container body 33 is small, a sufficient amount of toner can be scooped since the number of times of toner scooping per unit time is thus increased. Accordingly, the decrease in the amount of toner discharged from the opening 33*e* is suppressed better.

It is to be noted that the protruding rim 343 is not limited to the above-described structure in which the protruding rim 343 at the inner end 342 of the scooping face 341 projects downstream beyond the scooping face 341 in the rotation direction B in which the container body 33 rotates and the protruding rim 343 extends continuously from the upstream end 343*a* to the downstream end 343*b* in the toner conveyance direction A.

Figure 12A:
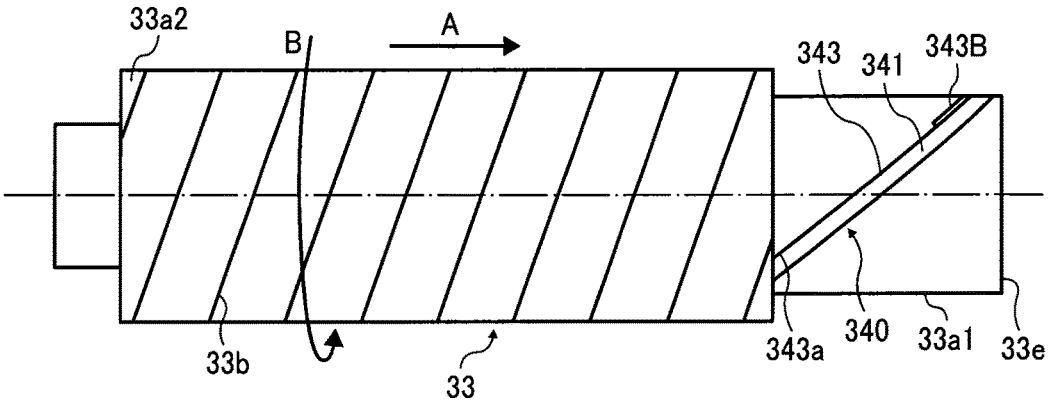
FIGS. 12A, 12B, and 12C are schematic views, each of which illustrates the protruding rim of the scooping portion according to another embodiment.

For example, in the structure illustrated in FIG. 12A, not the entire protruding rim 343 but a downstream portion 343B (adjacent to the downstream end 343*b* illustrated in FIG. 11) of the protruding rim 343 adjacent to the opening 33*e* projects downstream beyond the scooping face 341 in the rotation direction B. In this case, the toner scooped by the scooping face 341 does not spill out the protruding rim 343 on the side of the opening 33*e*.

Accordingly, the capability to discharge toner is improved, thereby better suppressing the decrease in the amount of toner discharged from the opening 33*e*.

Figure 12B:
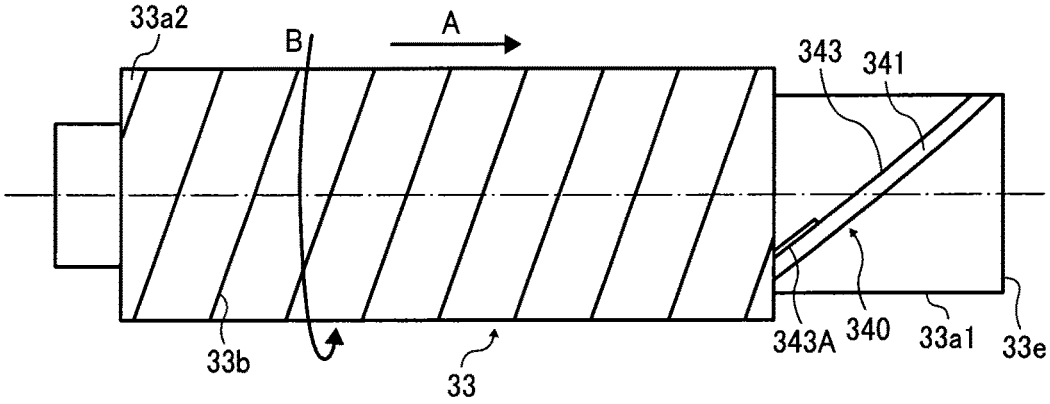

Alternatively, in the structure illustrated in FIG. 12B, not the entire protruding rim 343 but an upstream portion 343A (adjacent to the upstream end 343*a* illustrated in FIG. 11) in the toner conveyance direction A, projects downstream beyond the scooping face 341 in the rotation direction B. In this case, the toner scooped by the scooping face 341 does not spill out the protruding rim 343 on the side of the upstream end 343*a*, and the toner transported by the spiral rib 33*b* is drawn to the scooping portion 340, thereby guiding a greater amount of toner to the scooping portion 340. Accordingly, the capability to discharge toner is improved, thereby better suppressing the decrease in the amount of toner discharged from the opening 33*e*.

Figure 12C:
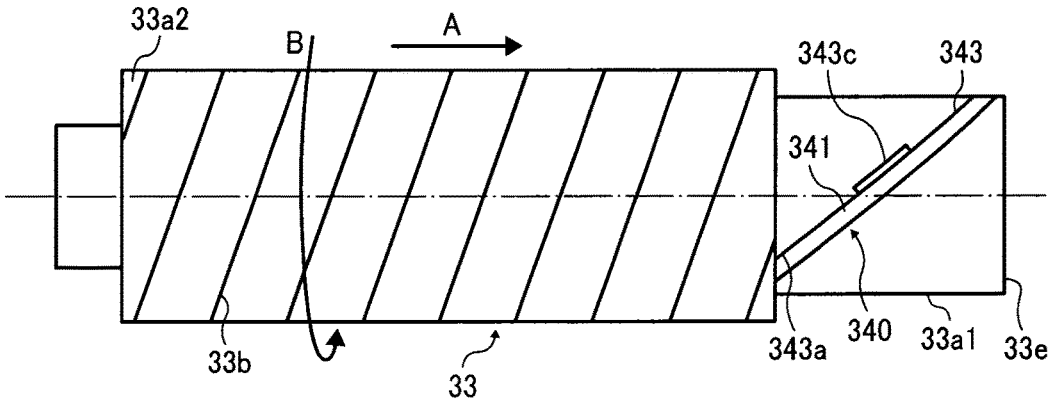

Alternatively, in the structure illustrated in FIG. 12C, an intermediate portion 343*c* located between the upstream end 343*a* and the downstream end 343*b* in the toner conveyance direction A projects downstream beyond the scooping face 341 in the rotation direction B. In this case, the toner scooped by the scooping face 341 is inhibited from spilling out the protruding rim 343 midway to the opening 33*e*. Accordingly, the capability to discharge toner is improved, thereby better suppressing the decrease in the amount of toner discharged from the opening 33*e*.

In the structures in which at least a portion of the protruding rim 343 projects beyond the scooping face 341 in the rotation direction B of the container body 33, referring to FIG. 13, it is preferred that a projecting amount H, which is the height of a top 343*d* of the protruding rim 343 projecting from the scooping face 341, be about 2 mm or greater. When the protruding rim 343 has the projecting amount H of 2 mm or greater, the effect to inhibit the toner from spilling out the protruding rim 343 is higher.

Additionally, a structure in which an angle θ2 between an inner face 343*e* of the protruding rim 343 and the scooping face 341 is 90 degrees or smaller is preferable since the effect to dam up the toner is higher.

Figure 14A:
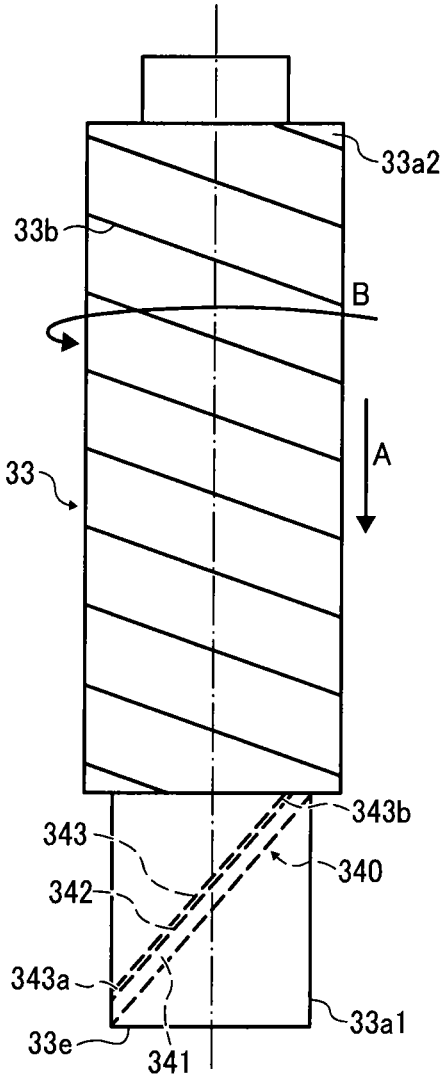
FIGS. 14A and 14B illustrate variations of the protruding rim of the scooping portion.
Figure 14B:
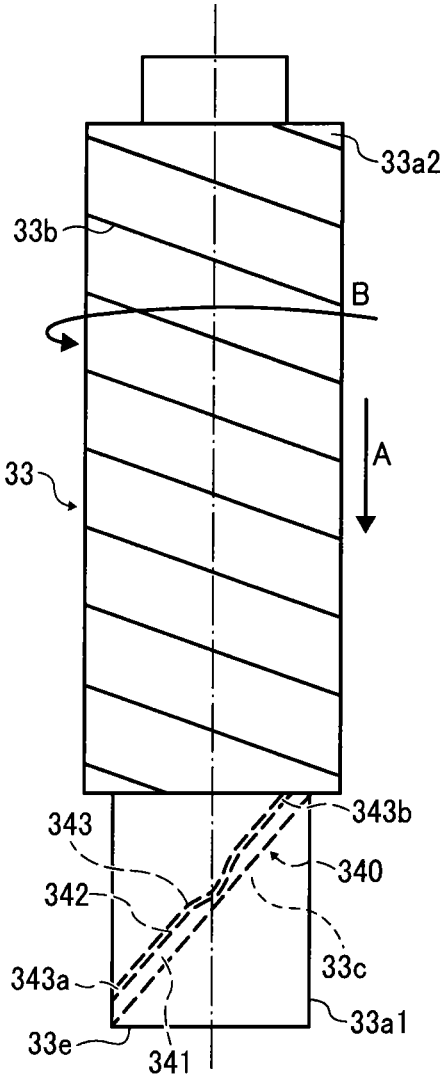

The shape of trajectory from the upstream end 343*a*, at which the protruding rim 343 starts, to the downstream end 343*b*, at which the protruding rim 343 ends, is not limited to the continuous spiral. In other embodiments, the trajectory from the upstream end 343*a* to the downstream end 343*b* is linear as illustrated in FIG. 14A, or a portion of the trajectory is recessed from the inner end 342 inward to the inner face 33*c* as illustrated in FIG. 14B. In other words, to facilitate the discharge of toner, the shape and arrangement of the protruding rim 343 are not limited as long as at least a portion of the protruding rim 343 at the inner end 342 of the scooping face 341 projects downstream beyond the scooping face 341 in the rotation direction B of the container body 33.

Figure 15A:
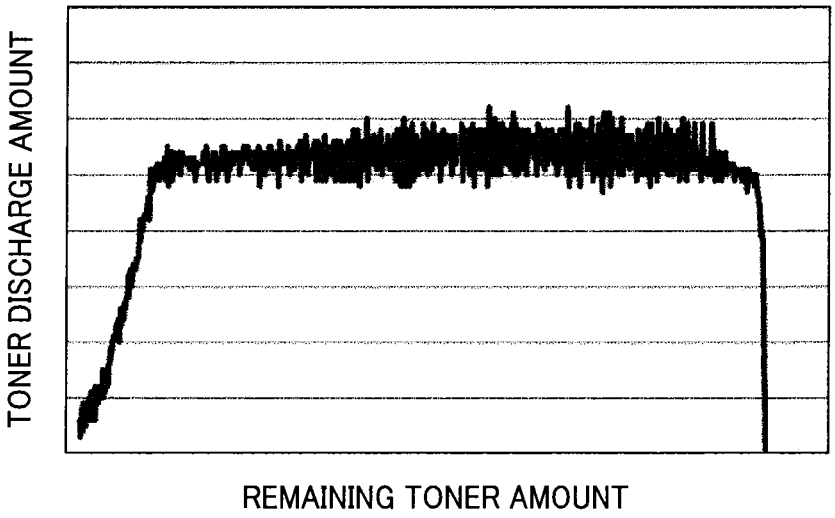
FIG. 15A is a graph illustrating a relation between the amount of toner discharged and the amount of toner remaining in the comparative toner container illustrated in FIGS. 9A and 9B.
Figure 15B:
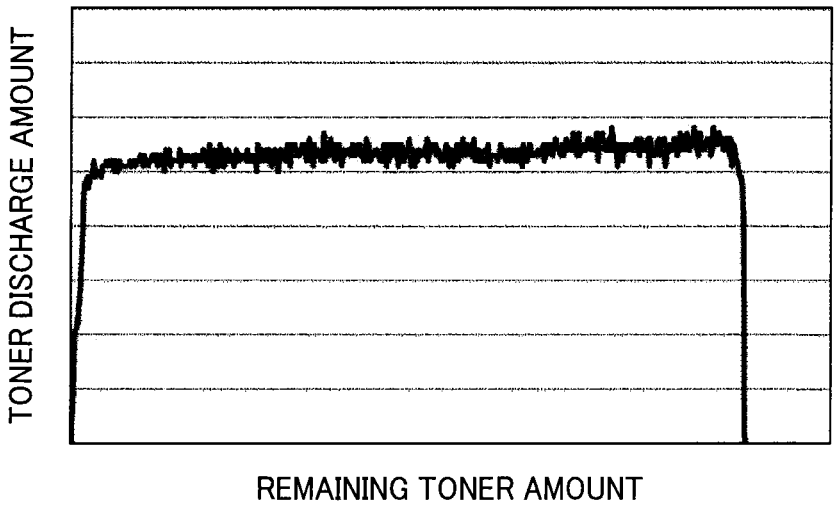
FIG. 15B is a graph illustrating a relation between the amount of toner discharged and the amount of toner remaining in the toner container illustrated in FIGS. 1A and 1B.

Referring to FIGS. 15A and 15B, descriptions are given below of an experiment to ascertain the relation between the amount of toner discharged from the toner outlet W and the amount of remaining toner in each of the comparative toner container 32X and the toner container 32 according to the present embodiment, in which the protruding rim 343 is continuous and projects beyond the scooping face 341. FIG. 15A is a graph illustrating the relation between the toner discharge amount and the remaining toner amount in the comparative toner container 32X in which the rim 343X does not projects downstream beyond the scooping face 341 in the rotation direction B. FIG. 15B is a graph illustrating the relation between the toner discharge amount and the remaining toner amount in the toner container 32 in which the protruding rim 343 projects downstream beyond the scooping face 341 in the rotation direction B. In FIGS. 15A and 15B, the ordinate represents the toner discharge amount, and the abscissa represents the remaining toner amount.

The experiment was conducted under the following test conditions. Both of the comparative toner container 32X and the toner container 32 according to the present embodiment were filled with toner of identical type and rotated at an identical rotation speed, and the amount of toner discharged from the opening 33*e* was measured.

According to the result of the experiment illustrated in FIGS. 15A and 15B, the present embodiment is advantageous over the comparative example in that the toner discharged amount is more stable even when the amount of remaining toner is small.

Figure 16:
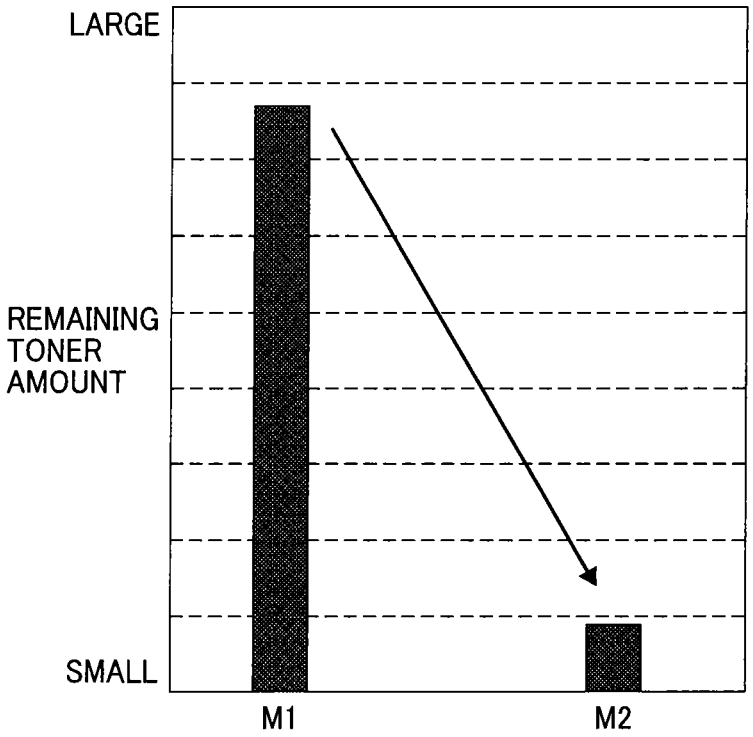
FIG. 16 is a graph illustrating the amount of toner remaining in each of the toner container illustrated in FIGS. 1A and 1B and the comparative toner container after image formation in the image forming apparatus illustrated in FIG. 2.

FIG. 16 is a graph illustrating the amount of remaining toner in the toner container 32 (M2 in FIG. 16) and the amount of remaining toner in the comparative toner container 32X (M1 in FIG. 16) after the toner container 32 and the comparative toner container 32X were used in the copier 500 illustrated in FIG. 2.

Specifically, each of the toner container 32 according to the present embodiment and the comparative toner container 32X was mounted in the copier 500, and an image having an image area ratio of 5% was repeatedly printed on two recording sheets (printing on two sheets and stop of image formation were repeated). The amount of toner remaining in the toner container 32 or 32X was measured when the copier reported the toner end. In FIG. 16, the ordinate represents the amount of toner remaining in the toner container 32 or 32X.

According to the result of the experiment, as illustrated in FIG. 16, the toner container 32 according to the present embodiment is advantageous over the comparative example in that the amount of toner left in the toner container 32 at the time of toner end report is smaller.

It is to be noted that the scope of the appended claims is not limited to the embodiments described above, but a variety of modifications can naturally be made within the scope of the present disclosure.

For example, image forming apparatuses in which aspects of the present disclosure are adopted are not limited to copiers but can be printers, facsimile machines, or multi-function peripherals having at least two of copying, printing, plotting, facsimile transmission, and scanning capabilities.

Although most preferable advantages are described above, advantages of the present disclosure are not limited to the advantages described above.

What is claimed is:

1. A powder container comprising:

a rotatable powder storage to store powder for image formation, the powder storage having an opening at one end of the powder storage;

a conveyor to transport the powder inside the powder storage toward the one end in a powder conveyance direction parallel to a rotation axis of the powder storage; and a scooping portion to scoop the powder and cause the powder to flow to the opening, the scooping portion including:

a scooping face extending from an inner face of the powder storage toward the rotation axis of the powder storage; and a rim, protruding inwardly, disposed along an inner end of the scooping face, wherein, on a cross section perpendicular to the rotation axis of the powder storage, at least a portion of the rim protrudes downstream beyond the scooping face in a rotation direction of the powder storage.

2. The powder container according to claim 1, wherein a downstream portion of the rim in the powder conveyance direction projects downstream beyond the scooping face in the rotation direction of the powder storage, the downstream portion on the one end having the opening.

3. The powder container according to claim 1, wherein an upstream portion of the rim in the powder conveyance direction projects downstream beyond the scooping face in the rotation direction of the powder storage.

4. The powder container according to claim 1, wherein an intermediate portion of the rim in the powder conveyance direction projects downstream beyond the scooping face in the rotation direction of the powder storage.

5. The powder container according to claim 1, wherein the conveyor is a spiral projection projecting inward from the inner face of the powder storage and spirals inside the powder storage to transport the powder inside the powder storage as the powder storage rotates, wherein the rim of the scooping portion is spiral-shaped, and wherein an inclination of the rim of the scooping portion relative to the powder conveyance direction is smaller than an inclination of the conveyor relative to the powder conveyance direction.

6. The powder container according to claim 1, wherein the scooping face is flat.

7. The powder container according to claim 1, wherein the powder includes toner.

8. An image forming apparatus comprising:

the powder container according to claim 1;

a powder supply device to transport the powder from the powder container; and an image forming unit including an image bearer, the image forming unit to form an image on the image bearer using the powder transported from the powder container by the powder supply device.

* * * * *